US005429906A

United States Patent [19]

Bowman et al.

[11] Patent Number: 5,429,906

[45] Date of Patent: Jul. 4, 1995

[54] SULFONATE-CONTAINING POLYMERIC BINDER IN DYE-DONOR ELEMENT FOR THERMAL DYE TRANSFER SYSTEMS

[75] Inventors: Wayne A. Bowman, Walworth; Karen M. Kosydar, Penfield, both of N.Y.

[73] Assignee: Eastman Kodak Company, Rochester, N.Y.

[21] Appl. No.: 198,020

[22] Filed: Feb. 17, 1994

[51] Int. Cl.[6] ..... B41M 5/035; B41M 5/26

[52] U.S. Cl. ..... 430/200; 430/201; 430/945; 503/227; 428/195; 428/913; 428/914

[58] Field of Search ..... 503/227; 430/200, 201, 430/471, 945; 428/913, 914, 195

[56] References Cited

U.S. PATENT DOCUMENTS

| | | | |
|---|---|---|---|
| 3,711,449 | 1/1973 | Breadley, Jr. | 526/287 |
| 5,030,612 | 7/1991 | Uytterhoeven et al. | 503/227 |
| 5,252,535 | 10/1993 | Martin et al. | 503/227 |
| 5,278,576 | 1/1994 | Kaszczuk et al. | 430/201 |

FOREIGN PATENT DOCUMENTS

| | | | |
|---|---|---|---|
| 0179737 | 4/1986 | European Pat. Off. . | |
| 60-190389 | 9/1985 | Japan | 117/36 |
| 61-262191 | 11/1986 | Japan | 117/36 |
| 4-83684 | 3/1992 | Japan . | |

*Primary Examiner*—Charles L. Bowers, Jr.
*Assistant Examiner*—Martin J. Angebranndt
*Attorney, Agent, or Firm*—Harold E. Cole

[57] ABSTRACT

This invention relates to a dye-donor element for thermal dye transfer comprising a support having thereon a dye layer comprising an image dye dispersed in a binder, wherein the binder comprises a water-dispersible vinyl copolymer having a glass transition temperature below about 54° C. and having the formula:

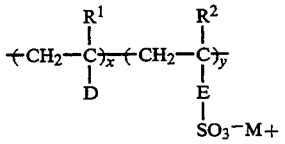

wherein:

$R^1$ and $R^2$ each independently represents hydrogen or methyl;

D represents a substituted or unsubstituted phenyl group; or —$COOR^3$, where $R^3$ represents a substituted or unsubstituted alkyl group of 1 to about 6 carbon atoms, a substituted or unsubstituted cycloalkyl group of about 5 to about 8 carbon atoms, or an organic group containing ethylenic unsaturation;

E represents —$C_6H_4$—; —$CONHR^4$—; or —$COOR^4$—, where $R^4$ represents an alkylene group of 1 to about 6 carbon atoms;

M represents a mono-charged cation,;

x represents 75 to 98 mole percent; and y represents 2 to 25 mole percent.

15 Claims, No Drawings

SULFONATE-CONTAINING POLYMERIC BINDER IN DYE-DONOR ELEMENT FOR THERMAL DYE TRANSFER SYSTEMS

This invention relates to the use of a particular sulfonate-containing polymeric binder in the dye-donor element of a thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. 4,621,271, the disclosure of which is hereby incorporated by reference.

In JP 61/262,191, there is a disclosure of a thermal dye transfer dye-donor element wherein the binder comprises a water-soluble polymer such as a natural gum, a cellulosic resin, gelatin, or poly(vinyl alcohol). Water-insoluble dyes must be dispersed as small particles to utilize such binders. However, there is a problem with these hydrophilic binders in that they contain many functional groups which can act as bridges between dye particles and lead to dye aggregation and flocculation, resulting in a low transferred D-max, as will be shown by comparative tests hereafter.

JP 60/190,389 describes the use of water-soluble or water-dispersible polyester and/or acrylate resin(s) as binders for dye-donor elements. There is a problem with these materials, however, in that there is adhesion of the dye-donor layer to the receiving layer during thermal dye transfer printing, as will be shown by comparative tests hereafter.

EPA 179,737 describes a binder for dye-donor elements containing both acrylic ester and acrylic acid. However, this copolymer also does not adequately solve the donor-receiver sticking problem, as will be shown by comparative tests hereafter.

It is an object of this invention to provide dye layer for a dye-donor element, coated from an aqueous dispersion, which provides good dye dispersion quality, efficient dye transfer (high D-max) on printing, and which eliminates or greatly reduces sticking of the dye-donor element to the dye-receiving element during printing.

These and other objects are achieved in accordance with this invention which comprises a dye-donor element for thermal dye transfer comprising a support having thereon a dye layer comprising an image dye dispersed in a binder, wherein the binder comprises a water-dispersible vinyl copolymer having a glass transition temperature below about 54° C. and having the formula:

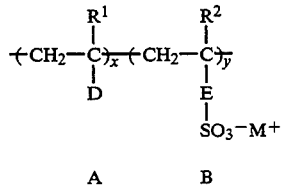

wherein:

$R^1$ and $R^2$ each independently represents hydrogen or methyl;

D represents a substituted or unsubstituted phenyl group; or —$COOR^3$, where $R^3$ represents a substituted or unsubstituted alkyl group of 1 to about 6 carbon atoms, a substituted or unsubstituted cycloalkyl group of about 5 to about 8 carbon atoms, or an organic group containing ethylenic unsaturation such as ethyleneglycol dimethacrylate, divinylbenzene, methylene bisacrylamide or any of the materials disclosed in column 4 of U.S. Pat. No. 4,865,946;

E represents —$C_6H_4$—; —$CONHR^4$—; or —$COOR^4$—, where $R^4$ represents an alkylene group of 1 to about 6 carbon atoms;

M represents a mono-charged cation, such as, for example, Na, K, or $NH_4$;

x represents 75 to 98 mole percent, preferably 90 to 95%; and y represents 2 to 25 mole percent, preferably 5 to 10%.

By use of the invention, sticking of the dye-donor element to the dye-receiving element during printing is significantly reduced or eliminated. In general, good results are obtained when the binder is used at a coverage of from about 0.1 to about 5 g/m$^2$.

In a preferred embodiment of the invention, D represents —$COOR^3$—, wherein $R^3$ is $CH_2CH_2OH$.

Examples of copolymers of the invention can be obtained using combinations of the monomers shown as follows:

TABLE 1

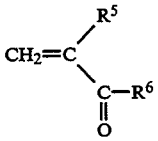

| | MONOMER | $R^5$ | $R^6$ |
|---|---|---|---|
| MM | methyl methacrylate | $CH_3$ | O—$CH_3$ |
| EM | ethyl methacrylate | $CH_3$ | O—$C_2H_5$ |
| BM | butyl methacrylate | $CH_3$ | O—$C_4H_9$ |
| BA | butyl acrylate | H | O—$C_4H_9$ |
| G | ethylene glycol dimethacrylate | $CH_3$ | O—$CH_2$—$CH_2$—O—C(O)C($CH_3$)=$CH_2$ |
| H | 2-hydroxyethyl methacrylate | $CH_3$ | O—$CH_2$—$CH_2$—OH |
| I | methacrylic acid, Na salt | $CH_3$ | O—$Na^+$ |
| SE | 2-sulfoethyl methacrylate, Na salt | $CH_3$ | O—$CH_2$—$CH_2$—$SO_3^-$ $Na^+$ |
| SA | sulfonated acrylamide, Na salt | H $Na^+$ | NH—C($CH_3$)$_2$—$CH_2$—$SO_3^-$ |

or

TABLE 1-continued

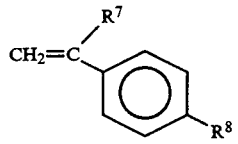

| MONOMER | $R^7$ | $R^8$ |
|---|---|---|
| P styrene | H | H |
| SP sulfonated styrene, Na salt | H | $SO_3^-Na^+$ |

TABLE 2

COPOLYMER COMPOSITIONS OF THE INVENTION (mole percent)

| ID | A(x) | | | B(y) |
|---|---|---|---|---|
| J-1 | BM(90) | | | SE(10) |
| J-2 | BM(60) | P(30) | | SE(10) |
| J-3 | BM(50) | P(30) | H(10) | SE(10) |
| J-4 | BM(60) | P(30) | | SA(10) |
| J-5 | BM(50) | P(30) | H(10) | SA(10) |
| J-6 | BM(65) | P(30) | | SE(5) |
| J-7 | BM(60) | P(30) | H(5) | SE(5) |
| J-8 | BM(55) | P(30) | H(10) | SE(5) |
| J-9 | BM(45) | P(30) | H(20) | SE(5) |
| J-10 | BM(55) | P(30) | H(5) | SE(10) |
| J-11 | BM(40) | P(30) | H(20) | SE(10) |
| J-12 | BM(50) | P(25) | H(10) | SE(15) |
| J-13 | BM(50) | P(15) | H(10) | SE(25) |
| J-14 | MM(40) | BA(40) | H(10) | SP(10) |
| J-15 | MM(50) | BA(40) | | SE(10) |
| J-16 | MM(44) | BA(44) | G(2) | SE(10) |
| J-17 | MM(40) | BA(40) | H(10) | SE(10) |
| J-18 | MM(50) | BA(30) | H(10) | SA(10) |
| J-19 | MM(50) | BA(30) | H(10) | SE(10) |
| J-20 | BA(30) | P(50) | H(10) | SE(10) |
| J-21 | BM(90) | | | SE(10) |
| J-22 | BM(80) | | H(10) | SE(10) |
| J-23 | MM(10) | BM(70) | H(10) | SE(10) |
| J-24 | BM(70) | | H(20) | SE(10) |
| J-25 | MM(10) | BM(60) | H(20) | SE(10) |
| J-26 | EM(10) | BM(60) | H(20) | SE(10) |

Any image dye can be used in the dye-donor employed in the invention provided it is transferable to the dye-receiving layer by the action of a thermal print head or laser. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D (products of Nippon Kayaku Co. Ltd.); acid dyes such as Kayanol Milling Cyanine 5R® (product of Nippon Kayaku Co. Ltd.); basic dyes such as Sumiacryl Blue 6CD® (product of Sumitomo Chemical Co., Ltd.), and Aizen Malachite Green® (product of Hodogaya Chemical Co., Ltd.);

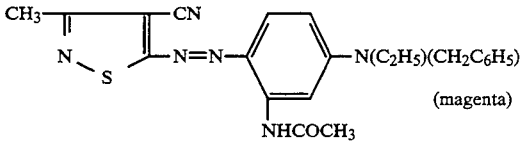

(magenta)

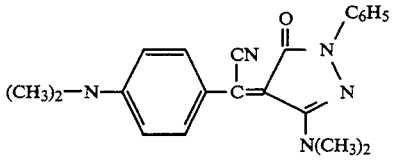

(magenta)

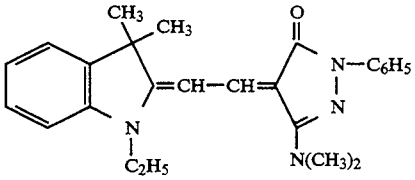

(yellow)

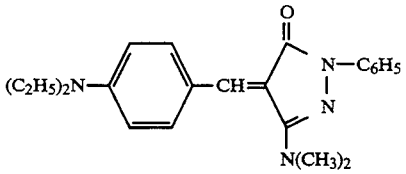

(yellow)

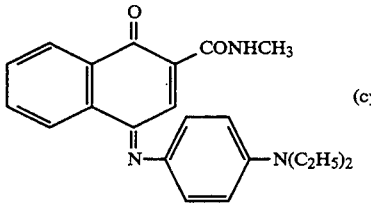

(cyan)

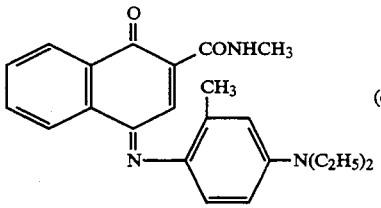

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 5 $g/m^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm and may also be coated with a subbing layer, if desired, such as those materials described in U. S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, microcrystalline wax, perfluorinated alkyl ester polyethers, polycaprolactone, silicone oils, poly(tetrafluoroethylene), carbowaxes, poly(ethylene glycols), or any of those materials disclosed in U.S. Pat. Nos. 4,717,711; 4,717,712; 4,737,485; and 4,738,950, and EPA 285,425, page 3, lines 25–35. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about .001 to about 2 g/m. If a polymeric binder is employed, the lubricating material is present in the range of 0.05 to 50 weight %, preferably 0.5 to 40 weight %, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly(vinyl chloride), poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or copolymers or mixtures thereof. The dye image-receiving layer may be present in any amount which is effective for the intended purpose. In general, good results have been obtained at a coverage of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U. S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black or cyanine infrared-absorbing dyes as described n U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described in U.S. Pat. No. 5,168,288, the disclosure of which is hereby incorporated by reference.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Preparation of Copolymer J-3

To a 3-L addition flask was added degassed distilled water (952 ml), Olin 10 G surfactant (50% solution, 37 ml), butyl methacrylate (654.1 g), styrene (287.5 g), 2-hydroxyethyl methacrylate (104.1 g), and 2-sulfoethyl methacrylate (178.7 g). The mixture was stirred under nitrogen. To a 5-L flask was added degassed distilled water (1905 q) and Olin 10 G surfactant (50% solution, 37 ml). The flask was placed into an 80° C bath. Potassium persulfate (12.24 g) and sodium metabisulfite (4.04 g) were added followed immediately by the contents of the addition funnel over a period of 50 min. Potassium persulfate (12.24 g) was added to the flask and the contents were stirred at 80° C. under nitrogen for 2 hours and then cooled. The pH of the resulting copolymer latex was adjusted to 7 by addition of sodium hydroxide (10% solution). The copolymer was filtered to remove a small amount of coagulum and contained 30.7% solids.

Preparation of Dye

A dispersion of the second yellow dye illustrated above was made by combining the dye (1500 g), Olin 10 G surfactant (10% solution, 2250 g), and deionized water (2250 g). The mixture was milled in a Netzsch horizontal media mill, model LME2, containing 0.7 mm zirconium silicate beads (2320 ml) for a total residence time of 110 min. The mean dispersion particle size was approximately 0.18 μm, as measured by a turbidimetric light scattering method.

The following copolymers are outside the scope of the invention based on composition and/or Tg and were used for comparisons in the examples hereafter.

TABLE 3

| COMPARISON COMPOSITIONS (mole percent) | | | | |
|---|---|---|---|---|
| ID | A(x) | | | B(y) |
| C-1 | BM(100) | | | |
| C-2 | BM(67) | P(33) | | 4 |
| C-3 | BM(60) | P(30) | H(10) | |
| C-4 | MM(20) | BM(60) | H(10) | SE(10) |
| C-5 | MM(60) | BA(20) | H(10) | SE(10) |
| C-6 | MM(30) | BM(50) | H(10) | SE(10) |
| C-7 | MM(70) | | H(20) | SE(10) |

The following polymers, described in other patents, were used as controls in the examples hereafter.

TABLE 4

| | CONTROL COMPOSITION (mole percent) | | | | |
|---|---|---|---|---|---|
| ID | A(x) | | | B(y) | PATENT |
| C-8 | BM(60) | | P(30) | I(10) | EPA-179737 |
| C-9 | BM(56) | P(30) | H(10) | I(10) | EPA-179737 |
| ID | CONTROL MATERIAL | | | | PATENT |
| C-10 | A-104 Acrylic Resin (Toa Gosei Kagaku Kogyo Co.) | | | | J60/190,389 |
| C-11 | poly(vinyl alcohol) | | | | J61/262,191 |

Preparation of Dye-Donor Elements

Yellow dye-donor elements were prepared by coating the following layers in order on a 6 μm poly(ethylene terephthalate) support:

1) a subbing layer of TYZOR-TBT ® (titanium tetra-n-butoxide, DuPont) (0.13 g/m$^2$) from an 85% propyl acetate/15% butanol solvent mixture, and
2) a dye layer containing the solid particle dispersion of the second yellow dye (0.32 g/m$^2$dye) illustrated above, a copolymer binder (0.75 g/m$^2$) identified in Table 5 below, and 10 G (nonionic surfactant, Olin Corp.) (0.09 g/m$^2$total) from water.

On the backside of the dye-donor element was coated:

1) a subbing layer of TYZOR-TBT ® (titanium tetra-n-butoxide, DuPont) (0.13 g/m$^2$) from an 85% propyl acetate/15% butanol solvent mixture, and
2) a slipping layer of CAP-482-0.5 (0.5 sec viscosity cellulose acetate propionate, Eastman Chemical Co.) (0.45 g/m2), CAP-482-20 (20 sec viscosity cellulose acetate propionate, Eastman Chemical Co.) (0.08 g/m2), PS-513, an aminopropyl dimethyl-terminated polydimethylsiloxane lubricant, Huls Co.) (0.01 g/m2), p-toluenesulfonic acid (Eastman Kodak Co.) (0.0003 g/m2), and Montan wax (0.03 g/m$^2$) from a 66.5% toluene/28.5% methanol/5% cyclopentanone solvent mixture.

In the same way, control dye-donors were prepared by substituting the following polymers for the copolymer binder of the invention in the dye layer: 1) A-104 (an aqueous dispersible acrylic resin, Toa Gosei Kagaku Kogyo Co., as disclosed in J60/190,389), and 2) poly(vinyl alcohol), >99% hydrolyzed, Eastman Kodak Co. as disclosed in J61/262,191.

Preparation of the Receiving Element

The dye-receiving element was prepared by coating the following layers in order onto a microvoided polypropylene layer laminated to a paper support as disclosed in U.S. Pat. No. 5,244,861 with a poly(vinyl alcohol)/poly(ethylene oxide) antistatic backing layer:

1) a subbing layer of Z-6020 (Dow Corning) (0.11 g/m$^2$) from 99% ethanol/1% water solvent mixture;
2) a receiving layer of KL3-1013 (polyether-modified bisphenol A polycarbonate, Bayer AG) (1.78 g/m2); Lexan 141 ® (bisphenol A polycarbonate, General Electric Co.) (1.45 g/m2); diphenyl phthalate (0.32 g/m2); dibutyl phthalate (0.32 g/m2); and Fluorad FC-431 ® (a perfluoro-sulfonamido surfactant, 3M Corp.) (0.01 g/m$^2$) from methylene chloride solvent; and
3) an overcoat layer of a bisphenol A polycarbonate containing 49 mol% diethylene glycol and 1 mol% polydimethylsiloxane (0.22 g/m2), DC-510 Silicone Fluid (Dow Corning, 0.008 g/m2), and Fluorad FC-431 ® (0.016 g/m$^2$) coated from methylene chloride solvent.

Printing

The dye side of the dye-donor element, approximately 10 cm×15 cm in area, was placed in contact with the molymeric receiving layer side of the dye-receiver element of the same area. The assemblage was fastened to the top of a motor-driven, 56 mm diameter, rubber roller and a TDK Thermal Head, model L-231, thermostatted at 25° C. was pressed with a force of 24.5 Newtons against the dye-donor element side of the assemblage pushing it against the rubber roller. This print head has 512 independently addressable heaters, of average heater resistance 504 Ohms, with a resolution of 5.4 dots/mm and an active printing width of 95 mm.

The image electronics were activated and the assemblage was drawn between the printing head and the roller at 21 mm/sec.

Coincidentally, the resistive elements in the thermal print head were pulsed "on" for 127 microseconds every 130 microseconds. Since the duty cycle for each pulse is >97%, this approximated pulse width modulation. Printing maximum density required 64 pulses of "on" time per printed line for a total 8.13 milliseconds of "on" time during the 8.7 millisecond allotted print time. A stepped density image was generated by incrementally increasing the number of pulses/dot from 0 to 64. The voltage supplied was 11.25 Volts resulting in an instantaneous peak power of approximately 0.251 Watts/dot and the maximum total energy required to print a maximum reflection density >2.0 was 2.04 milliJoules/dot.

Following the generation of a stepped image, the dye-donor was replaced with a donor-like sheet containing only subbing and slipping layers, and a uniform printing energy was applied to the entire print area using 58 pulses of "on" time per printed line.

The Status A Blue maximum density of the stepped image was read and recorded.

To evaluate donor-to-receiver sticking, after one stepped image was generated, the printing cycle was repeated with an unused area of dye-donor onto the same dye-receiver. (No uniform energy print step was used on prints in this test.) This printing was repeated until the dye-donor showed sticking to the receiver upon separation. The number of the first print which showed sticking was recorded as "prints-to-fail" (PTF). A value greater than 6 indicated that no sticking was observed on the 6th transfer and the test was discontinued.

For printing a single color image, a PTF value of 3 is adequate; however, a minimum value of 4 is required for generating a 3-color image and higher values are preferred. The results are given in Table 5.

TABLE 5

| COPOLYMER | BINDER Tg (°C.) | D-max | PRINTS TO FAIL |
|---|---|---|---|
| J-1 | 37 | 2.0 | 4 |
| J-2 | 41 | 2.2 | 5 |
| J-3 | 44 | 2.2 | >6 |
| J-4 | 42 | 2.2 | 4 |
| J-5 | 49 | 2.1 | >6 |
| C-1 | 34 | 2.1 | 1 |
| C-2 | 40 | 2.1 | 1 |
| C-3 | 43 | 2.1 | 2 |
| C-8 | 62 | 1.8 | 1 |
| C-9 | 62 | 1.9 | 2 |
| C-10 | 40 | NA | 1 |
| C-11 | 99 | 1.5 | 2 |

The comparison donors, C-1 to C-3, which did not have a sulfonate-containing monomer SE or SA in the binder, and the control donors C-8 to C-11, showed severe adhesion of the donor to the receiver, usually on the first print, resulting in low PTF values. The dye-donor elements according to the invention had much higher PTF values.

In addition, the control donors had a lower D-max in comparison to the dye-donor elements according to the invention.

EXAMPLE 2

This example is similar to Example 1 but used different copolymers and dye.

Preparation of Dye Dispersion

A dispersion of the first magenta dye illustrated above was made by combining the dye (400 g), Olin 10 G surfactant (10% solution, 400 g), and deionized water (1200 g). The mixture was milled in a Netzsch horizontal media mill, model LME1, containing 1.0 mm zirconium silicate beads (1000 ml) for a total residence time of 311 min. The mean dispersion particle size was approximately 0.18 μm, as measured by a turbidimetric light scattering method.

Preparation of Dye-Donor Elements

Dye-donor elements were prepared as described in Example 1 using a dye layer containing the magenta solid particle dye dispersion (0.32 g/m$^2$ dye), a copolymer binder identified in Table 6 (0.75 g/m2), and 10 G (nonionic surfactant, Olin Corp.) (0.074 g/m2).

Thermal dye transfer prints were prepared and evaluated as in Example 1 with the following results:

TABLE 6

| COPOLYMER | BINDER Tg (°C.) | D-max | PRINTS TO FAIL |
|---|---|---|---|
| J-2 | 41 | 2.0 | 3 |
| J-3 | 44 | 2.1 | >6 |
| J-7 | 44 | 2.1 | 3 |
| J-8 | 46 | 2.1 | 5 |
| J-9 | 48 | 2.1 | 5 |
| J-10 | 44 | 2.1 | >6 |
| J-11 | 50 | 2.2 | >6 |
| J-12 | 42 | 2.2 | >6 |
| J-13 | 43 | 2.1 | >6 |
| C-1 | 34 | 1.2 | 1 |
| C-2 | 42 | 1.6 | 1 |
| C-3 | 43 | 2.0 | 1 |

The above data show the significantly improved results in PTF obtained with the dye-donor elements of the invention as compared to several closely-related comparison binders. The D-max of the invention polymers were also significantly higher compared to two of the comparison polymers.

EXAMPLE 3

Magenta dye-donors were prepared and evaluated as in Example 2 for a variety of binder copolymer compositions as shown in Table 7. The following results were obtained:

TABLE 7

| COPOLYMER | BINDER Tg (°C.) | D-max | PRINTS TO FAIL |
|---|---|---|---|
| J-14 | 0 | 2.5 | >6 |
| J-15 | 13 | 2.5 | >6 |
| J-16 | 14 | 2.3 | >6 |
| J-17 | 15 | 2.5 | >6 |
| J-18 | 29 | 2.3 | 4 |
| J-19 | 33 | 2.2 | >6 |
| J-20 | 34 | 2.4 | >6 |
| J-21 | 37 | 2.2 | 4 |
| J-22 | 37 | 2.3 | 4 |
| J-12 | 42 | 2.2 | >6 |
| J-13 | 43 | 2.1 | >6 |
| J-7 | 44 | 2.1 | 3 |
| J-10 | 44 | 2.1 | >6 |
| J-3 | 44 | 2.1 | >6 |
| J-23 | 44 | 2.1 | 3 |
| J-24 | 45 | 2.2 | 4 |
| J-8 | 46 | 2.1 | 5 |
| J-25 | 48 | 2.1 | 3 |
| J-9 | 48 | 2.1 | 5 |
| J-5 | 49 | 2.3 | 5 |
| J-26 | 49 | 2.1 | 4 |

TABLE 7-continued

| COPOLYMER | BINDER Tg (°C.) | D-max | PRINTS TO FAIL |
|---|---|---|---|
| J-11 | 50 | 2.2 | >6 |
| C-4 | 54 | 2.0 | 2 |
| C-5 | 57 | 1.8 | 2 |
| C-6 | 62 | 2.0 | 2 |
| C-7 | 108 | 1.2 | 3 |

The above data show that the glass transition temperature should be lower than about 54° C. for the copolymer binders of the invention. The comparison polymers having a Tg of 54° C. or higher had either a poorer PTF or lower D-max or both.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye layer comprising a thermally transferable image dye dispersed in a binder, wherein said binder comprises a water-dispersible vinyl copolymer having a glass transition temperature below about 54° C. and having the formula:

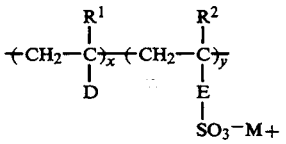

wherein:

$R^1$ and $R^2$ each independently represents hydrogen or methyl;

D represents a phenyl group; or —$COOR^3$, where $R^3$ represents an alkyl group of 1 to about 6 carbon atoms, a cycloalkyl group of about 5 to about 8 carbon atoms, or an organic group containing ethylenic unsaturation;

E represents —$C_6H_4$—; —$CONHR^4$—; or —$COOR^4$—, where $R^4$ represents a alkylene group of 1 to about 6 carbon atoms;

M represents a mono-charged cation selected from the group consisting of Na, K and $NH_4$;

x represents 75 to 98 mole percent; and y represents 2 to 25 mole percent.

2. The element of claim 1 wherein x is 90 to 95 mole %.

3. The element of claim 1 wherein y is 5 to 10 mole %.

4. The element of claim 1 wherein said binder is employed at a coverage of from about 0.1 to about 5 g/$m^2$.

5. The element of claim 1 wherein D represents —$COOR^3$, wherein $R^3$ is $CH_2CH_2OH$.

6. A process of forming a thermal dye transfer image comprising:

a) contacting at least one dye-donor element comprising a support having thereon a dye layer comprising a thermally transferable image dye dispersed in a binder with a dye-receiving element comprising a support having thereon a polymeric dye image-receiving layer;

b) imagewise-heating said dye-donor element; and c) transferring a dye image to said dye-receiving element to form said thermal dye transfer image, wherein said binder comprises a water-dispersible vinyl copolymer having a glass transition temperature below about 54° C. and having the formula:

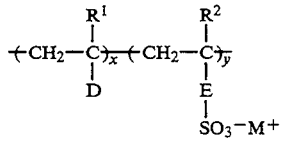

wherein:

$R^1$ and $R^2$ each independently represents hydrogen or methyl;

D represents a phenyl group; or —$COOR^3$, where $R^3$ represents alkyl group of 1 to about 6 carbon atoms, a cycloalkyl group of about 5 to about 8 carbon atoms, or an organic group containing ethylenic unsaturation;

E represents —$C_6H_4$—; —$CONHR^4$—; or —$COOR^4$—, where $R^4$ represents an alkylene group of 1 to about 6 carbon atoms;

M represents a mono-charged cation selected from the group consisting of Na, K and $NH_4$;

x represents 75 to 98 mole percent; and y represents 2 to 25 mole percent.

7. The process of claim 6 wherein x is 90 to 95 mole %.

8. The process of claim 6 wherein y is 5 to 10 mole %.

9. The process of claim 6 wherein said binder is employed at a coverage of from about 0.1 to about 5 g/$m^2$.

10. The process of claim 6 wherein D represents —$COOR^3$, wherein $R^3$ is $CH_2CH_2OH$.

11. A thermal dye transfer assemblage comprising:

(a) a dye donor element comprising a support having thereon a dye layer comprising a thermally transferable image dye dispersed in a binder, and (b) a dye-receiving element comprising a support having thereon a dye image-receiving layer, said dye-receiving element being in superposed relationship with said dye-donor element so that said dye layer is in contact with said dye image-receiving layer, wherein said binder comprises a water-dispersible vinyl copolymer having a glass transition temperature below about 54° C. and having the formula:

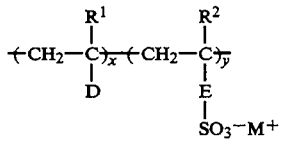

wherein:

$R^1$ and $R^2$ each independently represents hydrogen or methyl;

D represents a phenyl group; or —$COOR^3$, where $R^3$ represents an alkyl group of 1 to about 6 carbon atoms, a cycloalkyl group of about 5 to about 8 carbon atoms, or an organic group containing ethylenic unsaturation;

E represents —$C_6H_4$—; —$CONHR^4$—; or —$COOR^4$—, where $R^4$ represents an alkylene group of 1 to about 6 carbon atoms;

M represents a mono-charged cation selected from the group consisting of Na, K and $NH_4$;

x represents 75 to 98 mole percent; and y represents 2 to 25 mole percent.

12. The assemblage of claim 11 wherein x is 90 to 95 mole %.

13. The assemblage of claim 11 wherein y is 5 to 10 mole %.

14. The assemblage of claim 11 wherein said binder is employed at a coverage of from about 0.1 to about 5 $g/m^2$.

15. The assemblage of claim 11 wherein D represents $—COOR^3$, wherein $R^3$ is $CH_2CH_2OH$.

* * * * *